US006561155B1

(12) United States Patent
Williams

(10) Patent No.: US 6,561,155 B1
(45) Date of Patent: May 13, 2003

(54) PUMPING APPARATUS FOR AN INTERNAL COMBUSTION ENGINE

(75) Inventor: David Williams, Hampton on the Hill (GB)

(73) Assignee: Dana Automotive Limited, Warwickshire (GB)

( * ) Notice: Subject to any disclaimer, the term of this patent is extended or adjusted under 35 U.S.C. 154(b) by 0 days.

(21) Appl. No.: 09/807,209

(22) PCT Filed: Oct. 8, 1999

(86) PCT No.: PCT/GB99/03350

§ 371 (c)(1),
(2), (4) Date: Jun. 13, 2001

(87) PCT Pub. No.: WO00/22284

PCT Pub. Date: Apr. 20, 2000

(30) Foreign Application Priority Data

Oct. 12, 1998 (GB) ..... 9822152
Jun. 14, 1999 (GB) ..... 9913584

(51) Int. Cl.[7] ..... F01M 1/00

(52) U.S. Cl. ..... 123/196 S; 123/41.33; 123/196 AB; 184/6.4

(58) Field of Search ..... 123/196 R, 196 AB, 123/196 S, 196 M, 41.33, 41.14; 417/357, 366, 423.3, 423.8, 313, 410.1; 184/6.3, 6.4; 310/52–65

(56) References Cited

U.S. PATENT DOCUMENTS 4,079,275 A 3/1978 Fu
4,502,431 A 3/1985 Lulich
4,519,755 A * 5/1985 Hanson ..... 418/9
5,111,090 A 5/1992 Otake et al.
5,145,348 A * 9/1992 Zumbusch ..... 418/171
5,217,085 A * 6/1993 Barrie et al. ..... 184/104.1
5,336,064 A * 8/1994 Lamers ..... 417/423.3
5,360,322 A 11/1994 Henein et al.
5,743,231 A * 4/1998 Reinosa ..... 123/196 S
5,765,521 A 6/1998 Stützle et al.
6,349,692 B1 * 2/2002 Reinosa ..... 123/196 S

FOREIGN PATENT DOCUMENTS

| | | |
|---|---|---|
| EP | 0163126 | 12/1985 |
| EP | 0178087 | 4/1986 |
| EP | 0272151 | 6/1988 |
| GB | 2009849 | 6/1979 |
| GB | 2323412 | 9/1998 |

* cited by examiner

*Primary Examiner*—Noah P. Kamen
(74) *Attorney, Agent, or Firm*—Dykema Gossett PLLC

(57) ABSTRACT

An apparatus (10) for pumping lubricant in an internal combustion engine, includes a lubrication pump (11) for the lubricant, and electric motor means (12) for driving the pump (11), the lubricant being contained in reservoir(s) in which at least the lubrication pump (11) is immersed, and the motor means (12) including a stator (14) and rotatable motive member (15) the stator (14) and rotatable motive member (15) being in contact with the lubricant from the reservoir(s).

14 Claims, 8 Drawing Sheets

14
H
12
11
P1
15
17
18
W
P2
29
27
C
45
26
26
30
3
FIG
31
F
28
S

FIG 5a
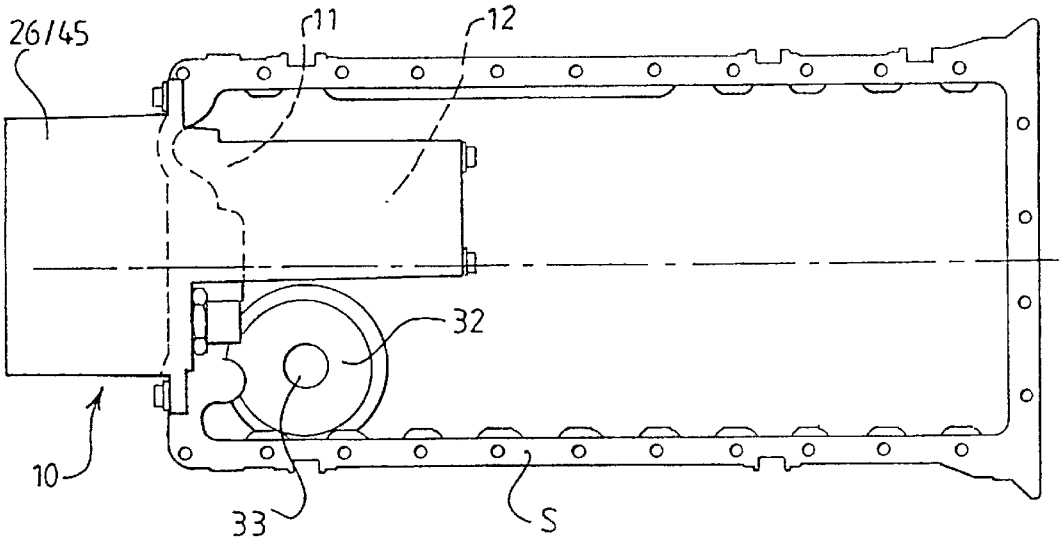
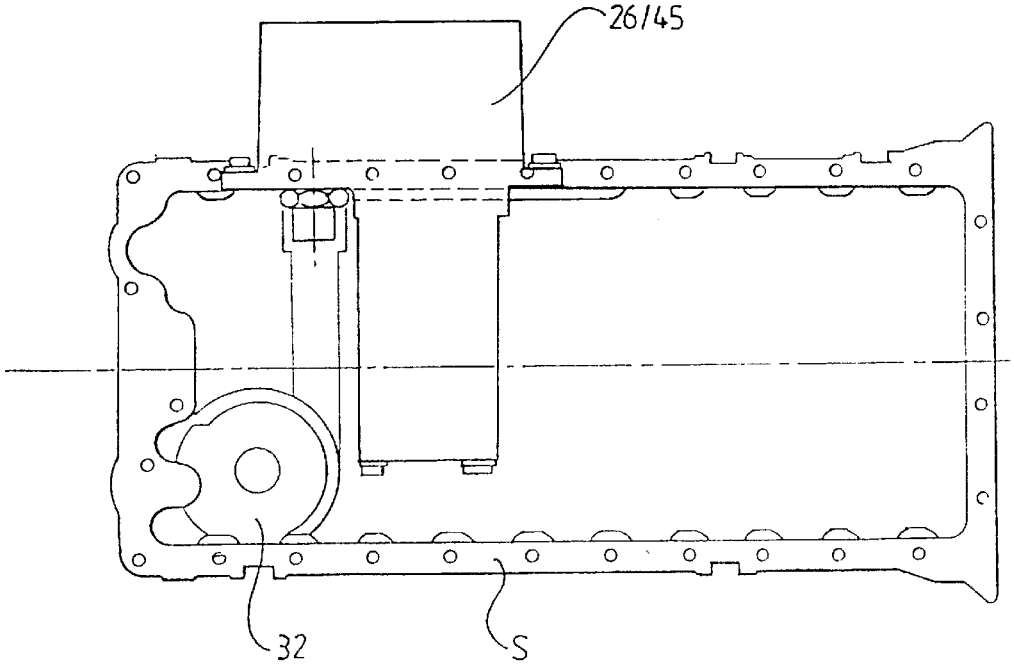
FIG 5b

PUMPING APPARATUS FOR AN INTERNAL COMBUSTION ENGINE

DESCRIPTION OF INVENTION

This application claims priority under 35 U.S.C §365(c) to international patent application PCT/GB99/03350 filed Oct. 8, 1999, which in turn claims priority to United Kingdom patent application 9822152.6 filed Oct. 12, 1998 and United Kingdom patent application 9913584.0 filed Jun. 14, 1999, the entire disclosures of which are incorporated herein by reference.

This invention relates to a pumping apparatus and more particularly to a pumping apparatus for pumping lubricant in an internal combustion engine, and to a sump and an engine incorporating such a pumping apparatus.

In an internal combustion engine it is common practice to provide a lubricant pump which is operative to pump lubricant, usually oil, to parts of the engine which require lubrication. The oil drains back to a sump under gravity.

Known such pumps are driven by a mechanical coupling with a driven part of the engine, such as from a gear or cam carried by e.g. the camshaft or crankshaft of the engine. Thus the choice of positions at which the oil pump must be sited, is restricted by the nature of the mechanical coupling. The pump is only driven when the driven part of the engine moves, i.e. when the engine is running.

As a result, during start-up of an engine particularly from cold, there is a short period before an adequate supply of oil is delivered to the engine parts which require lubrication. Thus during start-up, the engine is particularly prone to wear.

Also in modern engines which incorporate parts which rotate at high speed, such as the rotor of a turbocharger, such rotating parts tend to continue to rotate for some time after the engine is switched off and the driven part of the engine from which the oil pump is driven, stops moving. Thus such rotating parts tend to be inadequately lubricated when the engine is switched off and wear is aggravated as such rotation results in a temperature rise due to the cessation of force fed lubrication, which acts as a heat transfer means.

Another problem with conventional oil pumps is the necessity to provide pipework for a supply of oil to and delivery of oil from the oil pump, which can be complicated by the position at which the oil pump is mounted being governed by the mechanical coupling to the driven part of the engine.

Yet another problem with conventional oil pumps which are driven by a driven part of the engine is the inability to control the speed of the pump other than as a result of engine speed. Particularly, as engine speed increases, so will the oil flow delivered by the pump. At high engine speeds, it would be preferable to limit the oil pump speed for the most efficient lubrication of the engine, and to limit wear on the oil pump itself.

It is well known to drive a pump using an electric motor but this has not been adopted generally in an engine environment for several reasons. First, there are the economic considerations of providing a motor driven pump. Second, a motor would generate heat and would itself require cooling.

According to a first aspect of the invention we provide an apparatus for pumping lubricant in an internal combustion engine, the apparatus including a lubrication pump for pumping the lubricant, and electric motor means for driving the pump, the lubricant being pumped from a reservoir in which at least the lubrication pump is immersed, and characterised in that the motor includes a stator and a rotatable motive member, the stator and rotatable motive member of the motor means being in contact with lubricant from the reservoir.

Thus the temperature of the motor may be stabilised by the lubricant in contact with it, and furthermore, the motive member and/or bearings carrying the motive member may readily be lubricated. Because the pump is driven by a motor and not a mechanical coupling from a driven part of the engine or other machine, there is less restriction on the positioning of the pump compared with conventional arrangements.

Thus the potential technical problems of using a motor driven pump e.g. for pumping lubricant in an internal combustion engine or other machine, may be overcome. Even though a motor driven pump may be more expensive than a conventional pump driven e.g. from a driven part of the engine, the benefits achieved may offset this extra cost.

Amongst the advantages of providing a pumping apparatus in accordance with the invention in such an environment arc that the speed of the pump may be controlled because the pump is not mechanically coupled to a driven part of the engine; the pump may be actuated independently of the engine and thus may pump lubricant prior to start-up and subsequent to switching off the engine so that the engine is less prone to wear during such periods; the performance of the motor/pump may be used as a diagnostic tool for diagnosing a) engine malfunctions such as for example a blockage in a lubrication passageway, and b) engine wear which tends to result in an increased requirement for lubricant to be pumped.

Preferably the reservoir in which at least the lubricant pump is immersed, is a sump of the engine from which lubricant is pumped to moving parts of the engine.

In one embodiment, the pump and the motor means are arranged with the pump and the motor means immersed in lubricant in the reservoir. Thus the motor need not have a housing or other outer casing. In another embodiment where the pump only is immersed in the lubricant, the motor means may include a motor housing with one or more passages for the lubricant e.g. from the pump, to the interior of the motor housing. In each case by virtue of the pump and/or pump and motor means being immersed in the fluid in the sump, the temperature of the motor means and the pump will be stabilised by the fluid and will realise the temperature of the lubricant.

By providing a pump or pump and motor means which are positioned in the sump, there is no need to provide pipework to the pump for the fluid to be pumped. Preferably, the pump is connected to a remote filter which filters the fluid e.g. prior to the lubricant being directed to moving parts of the engine.

In a preferred arrangement, the fluid to be pumped may be pumped by the pump through a heat exchanger where the lubricant is cooled by a coolant in thermal contact therewith. The coolant may be for example only, water or another coolant which may be predominantly water or the like.

Preferably the heat exchanger is located closely adjacent to a housing of the pump exteriorly of the reservoir, e.g. in the air, so that the air may perform some cooling of the fluid. Where the pump pumps fluid from the sump to a filter, a fluid outlet from the heat exchanger may be connected directly to a housing in which the filter is provided or the filter housing may be integral with the or a housing of the apparatus.

The motor is preferably an electric motor in which case there may be provided a control means for the motor. The control means may be of an electronic nature, the temperature of which may need to be retained below a threshold level. Most conveniently the control means is positioned at least adjacent the pump so that there is no need for there to be long leads between the control means and the motor. Where there is provided a heat exchanger through which a coolant flows to cool the fluid to be pumped, the control means may too be cooled by the coolant. For example the control means may be contained in a housing in thermal contact with the heat exchanger.

The control means may be adapted operatively to be connected to a management system controlling an engine or other machine in which the fluid is to be pumped.

In another embodiment the motor is an electric motor having external stator windings and an internal rotor, the internal rotor includes an axially extending opening with generally radially inwardly formations such as gear-like teeth, and the pump includes an impeller which is received in the axially extending opening, the impeller having generally radially outwardly extending formations such as gear-like teeth, which co-operate with the radially inwardly extending formations of the rotor so that the impeller is driven as the rotor rotates, the radially outwardly extending formations of the impeller pumping the fluid as the impeller is rotated.

Thus the impeller and motor may be integrated substantially to reduce the axial extent of the apparatus compared with an apparatus in which an impeller is connected at an axial end of a motor rotor or other rotatable motive member of the motor. Thus a more efficient design may be achieved with inherent reductions in manufacturing cost and time. The overall size and mass of the apparatus may be lower than that of a comparable apparatus with non-integrated motor and pump elements.

In a preferred arrangement of this alternative embodiment, the impeller may rotate in the axially extending opening of the internal rotor about an axis which is parallel to but spaced from an axis about which the internal rotor rotates whereby in use, at any time, only some of the co-operating formations of the internal rotor and the impeller are in co-operation, and a pumping cavity for fluid to be pumped, is provided between the internal rotor and the impeller.

According to a second aspect of the invention we provide an internal combustion engine having a sump for lubricant to be pumped, and an apparatus according to the first aspect of the invention to pump the lubricant in the engine.

The engine is preferably provided with a management system which may interface with a control means of the apparatus, which is operative to control the motor speed, the management system and control means controlling pump speed according to engine operating conditions.

According to a fourth aspect of the invention we provide a method of operating an engine of the third aspect of the invention the method including actuating the pumping apparatus prior to start-up of the engine and/or subsequent to switching off of the engine.

According to a fifth aspect of the invention we provide a method of performing diagnosis of an engine malfunction including providing to an engine management system, an input from a control means of an electric motor of pumping apparatus of the first aspect of the invention.

The invention will now be described with reference to the accompanying drawings in which.

Figure 5C:
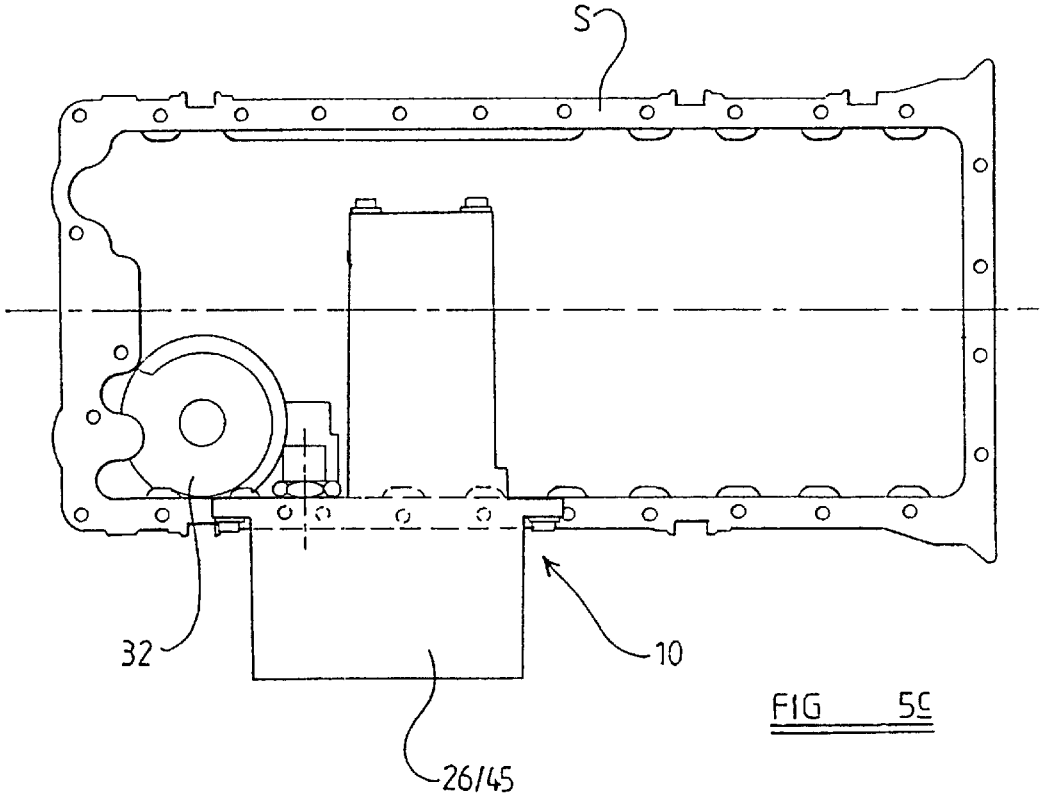

FIGS. 5*a*, 5*b*, 5*c* show alternative ways in which the pumping apparatus of the invention may be mounted with respect to a sump.

Figure 6:
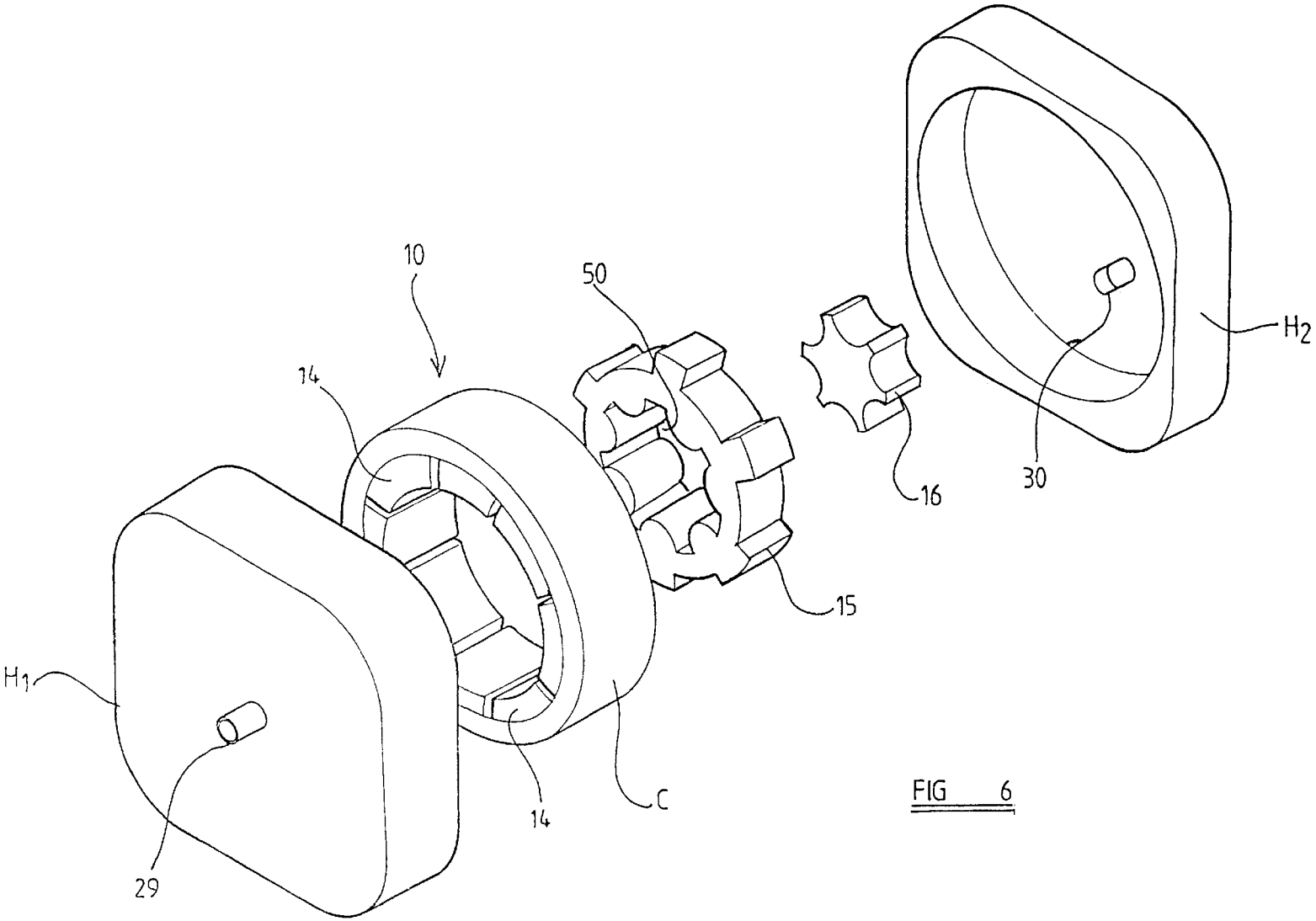
Figure 7:
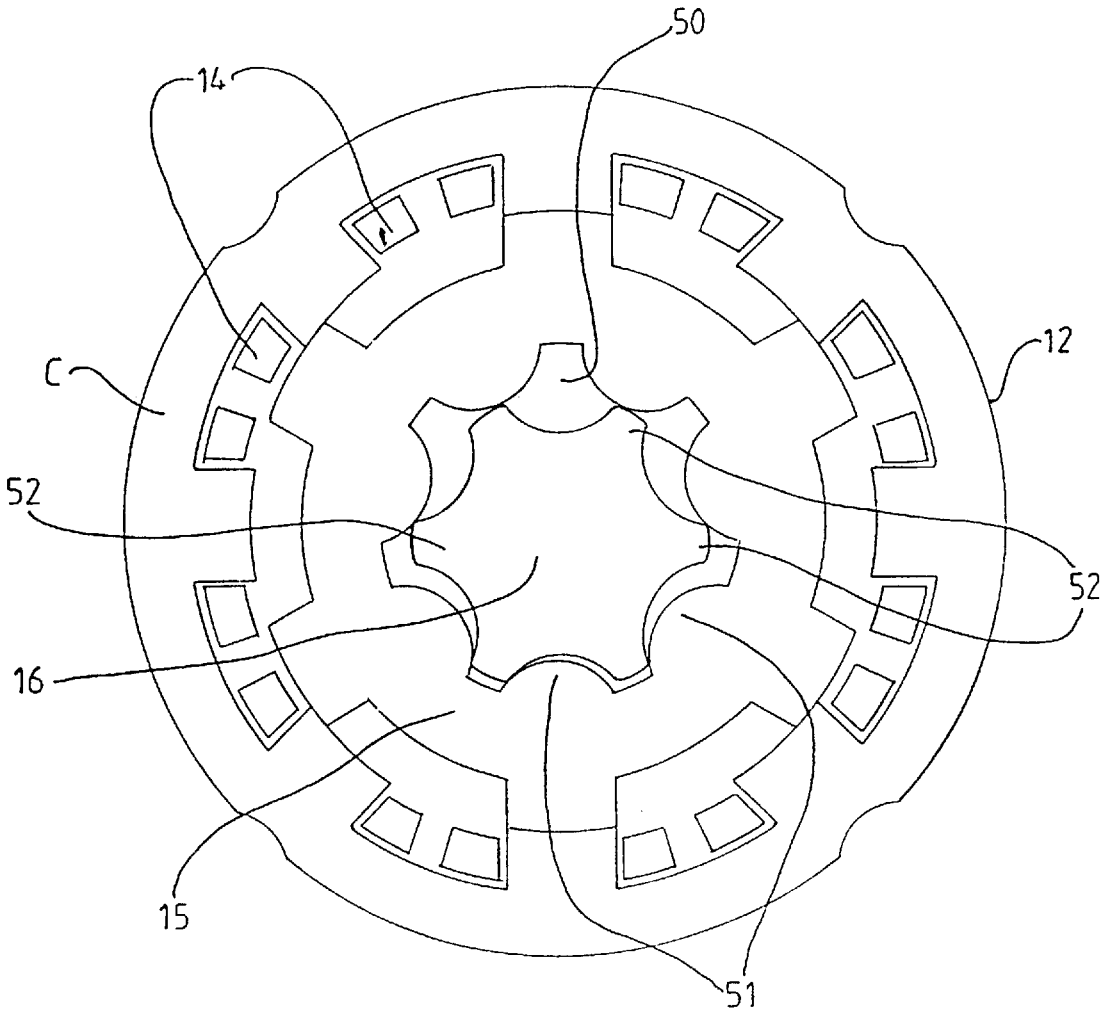

FIG. 6 is an exploded illustrative perspective view of a yet another alternative embodiment of the invention; and FIG. 7 is an illustrative end view of the embodiment of FIG. 6.

Figure 1:
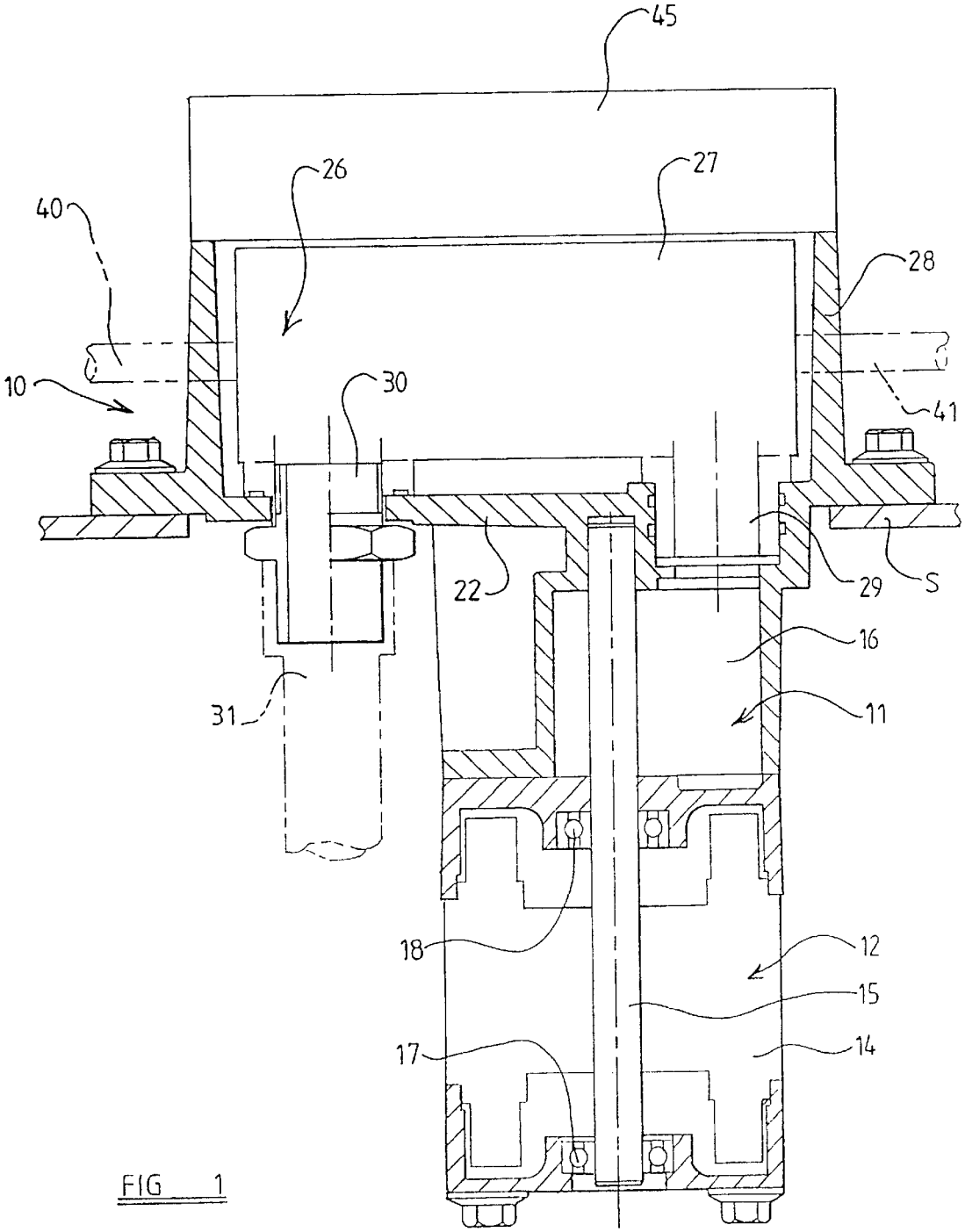
FIG. 1 is a diagrammatic cross sectional view through a pumping apparatus in accordance with the invention.
Figure 2:
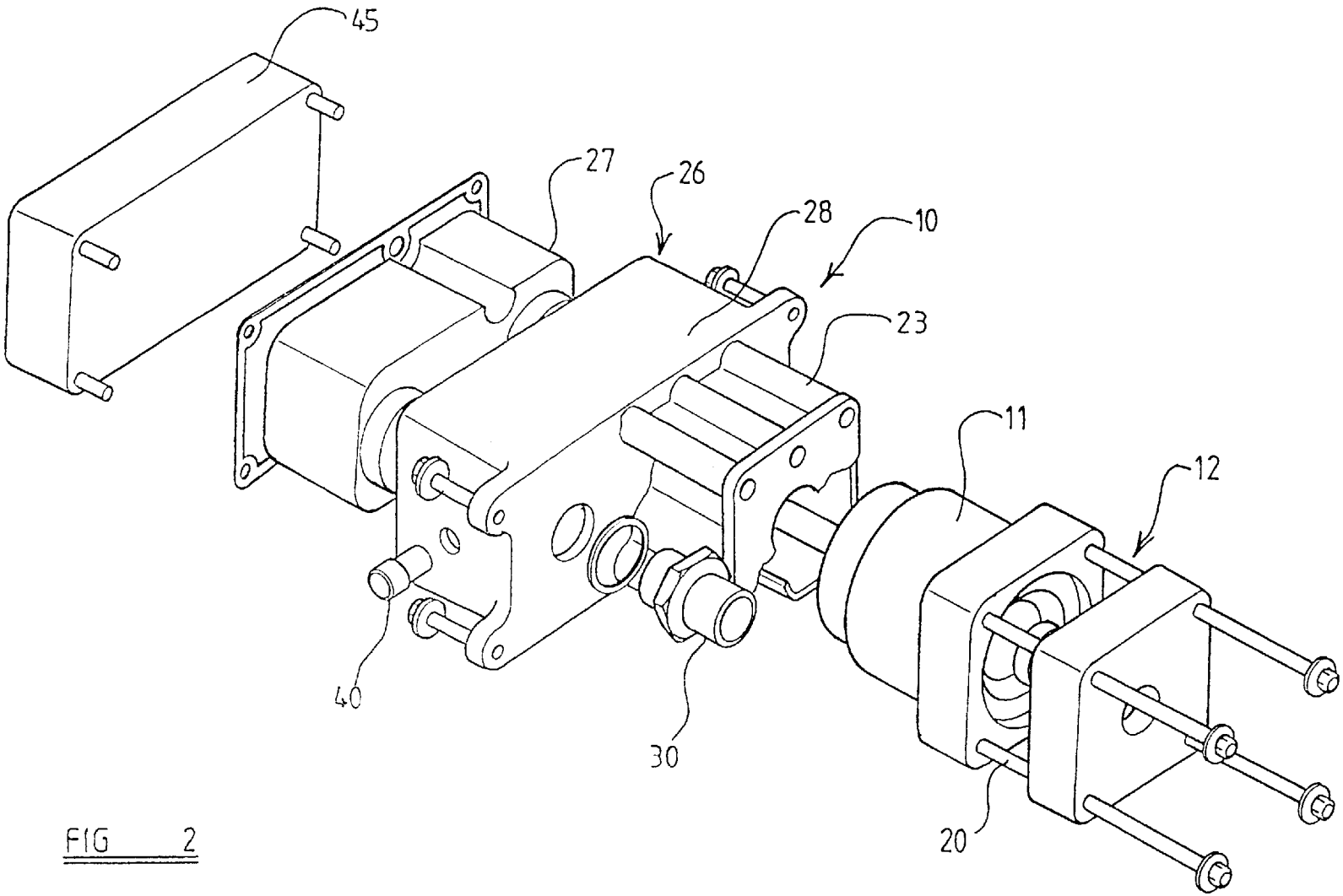
FIG. 2 is an illustrative perspective view of the apparatus of FIG. 1 shown in an exploded condition.

Referring first to FIGS. 1 and 2 there is shown a pumping apparatus 10 for pumping oil or other lubricant in an internal combustion engine.

The apparatus 10 includes a pump 11 which may be a rotor pump, a sliding vane pump, a ring pump or any other pump 11 suitable for pumping the oil. The pump 11 is driven by a motor 12 which in this example is an electric motor 12 having stator windings 14 and a rotor 15 being a motive means which is connected directly axially to an impeller 16 of the pump 11.

The rotor 15 is carried by bearings 17,18 at each end, which bearings 17,18 are carried by a motor frame 20, although in this embodiment, the motor 12 has no housing or other casing.

The pump 11 includes a base wall 22 of a housing 23 thereof, the base wall 22 being adapted to be secured in an opening of a sump S of the engine, with a suitable sealing means being provided between the sump S and the wall 22. Thus the pump 11 and the motor 12 are within the sump S and in use are immersed in oil in the sump S. Thus the oil is in contact with the interior parts of the motor 12 particularly with the rotor 15 thereof so that the bearings 17,18 are lubricated by the oil, and the windings 14 are in heat transfer relationship with the oil. Thus the temperature of the motor 12 and particularly of the windings 14 is stabilised by being in contact with the oil of the sump S.

Typically the oil in a sump of an internal combustion engine will attain a temperature of about 140° C. The motor 12 will of course need to be able to operate in an environment of this temperature. Typically a motor may operate in an environment of up to 200° C.

An internal combustion engine is typically cooled by a coolant such as water or a coolant which is predominantly water, which is itself cooled by a flow of cooling air through a radiator. The coolant is pumped around the engine in a jacket to cool the engine.

In accordance with the invention, there is provided an oil cooler 26 through which the oil is pumped by the pump 11 prior to the oil being directed to the engine parts where lubrication is required. The oil cooler 26 comprises a heat exchanger 27 in a housing 28, the head exchanger housing 28 being in direct thermal contact with the pump housing 23. The base wall 22 of the pump housing 23 in this embodiment is a common wall between the pump housing 23 and the heat exchanger housing 28 such that the heat exchanger housing 28 and the pump housing 23 are integrally provided in this embodiment, but could be separately provided and attached as desired.

The heat exchanger 27 has an inlet 29 for oil from the pump 11 and an outlet 30. In this example the outlet 30 is connected directly to a conduit 31 for the oil to a housing 32 of a filter 33 as shown in figures 5*a*, 5*b*, and 5*c*. These figures show different positions of the sump S at which the pumping apparatus 10 may be provided. The oil outlet 30 from the heat exchanger 26 in this example passes through the base wall 22 of the pump housing 23 and heat exchanger housing 28.

Coolant is supplied to a coolant inlet 40 of the heat exchanger 27 and flows in thermal contact with the oil, though the heat exchanger 27 to an outlet 41 from where the oil may pass to the coolant jacket of the engine, or to the radiator of the engine.

The coolant will typically attain a temperature of 90° C. in use and thus the oil passing through the heat exchanger 27 will be cooled.

The speed of the motor 12 is controlled by a control means 45 which conveniently is electronic in nature, there being leads from the control means 45 to the motor 12 which are not illustrated in the figures. The control means 45 may be operatively connected via electric leads or tubing, to a pressure sensor (not shown) for example which senses the oil pressure of the pumped oil and may control the motor 12 and thus the pump 11 speed, depending on oil pressure. Alternatively the motor speed may be controlled as a function of temperature or flow, or a combination of any of these. There may optionally be an input from an engine management system so that the optimum motor 12 speed can be attained for a given engine speed and oil pressure although in each case, the pump 11 speed may be controlled independently of the engine speed i.e. such that the pump speed is not wholly dependent on the engine speed as is the case with a conventional mechanical coupling drive.

It is envisaged that the engine management system may operate such that the pump 11 is caused to pump prior to the engine being started such that there will be a flow of lubricant to movable parts of the engine prior to such movable parts being driven. For example when an operative operates an ignition or other starter switch, there may be a short pause before the engine starts while an adequate flow of lubricant is achieved by the pump 11 being operated by a control signal from the engine management system to the control means 45.

Furthermore, in the event of any engine part such as a turbocharger rotor continuing to rotate for some time after the engine is switched off, the engine management system may be arranged to signal the control means 45 to continue to operate the pump 11 so as to provide a flow of lubricant to the bearings of such moving part for some time after the engine has been switched off.

This the control means 45 may interface with the engine or other machine management system for optimum performance.

Also, if required, an output from the control means 45 may be used by the engine management system in fault diagnoses, e.g. to determine oil passage blockage in the engine.

Because the control means 45 is provided adjacent the heat exchanger 27, and in thermal contact therewith, the electronics of the control means 45 will be subject to the cooling effect of the coolant through the heat exchanger 27. Thus the temperature of the electronics of the control means 45 will be stabilised by the heat exchanger 27 and will be prevented from rising above the coolant temperature.

Various modifications may be made without departing from the scope of the invention. For example, in another arrangement, the apparatus 10, or at least the component parts thereof which in use lie inside the sump S, may be provided integrally with the sump S rather than being attached thereto as described, the pump housing 23 base wall 22 being part of a wall of the sump S.

In the example described, the pump 11 and the motor 12 are arranged axially, but need not be in another arrangement. In the example described so far, the oil cooler 26 is also arranged generally axially with the motor 12 and pump 11, but again need not be.

Figure 3:
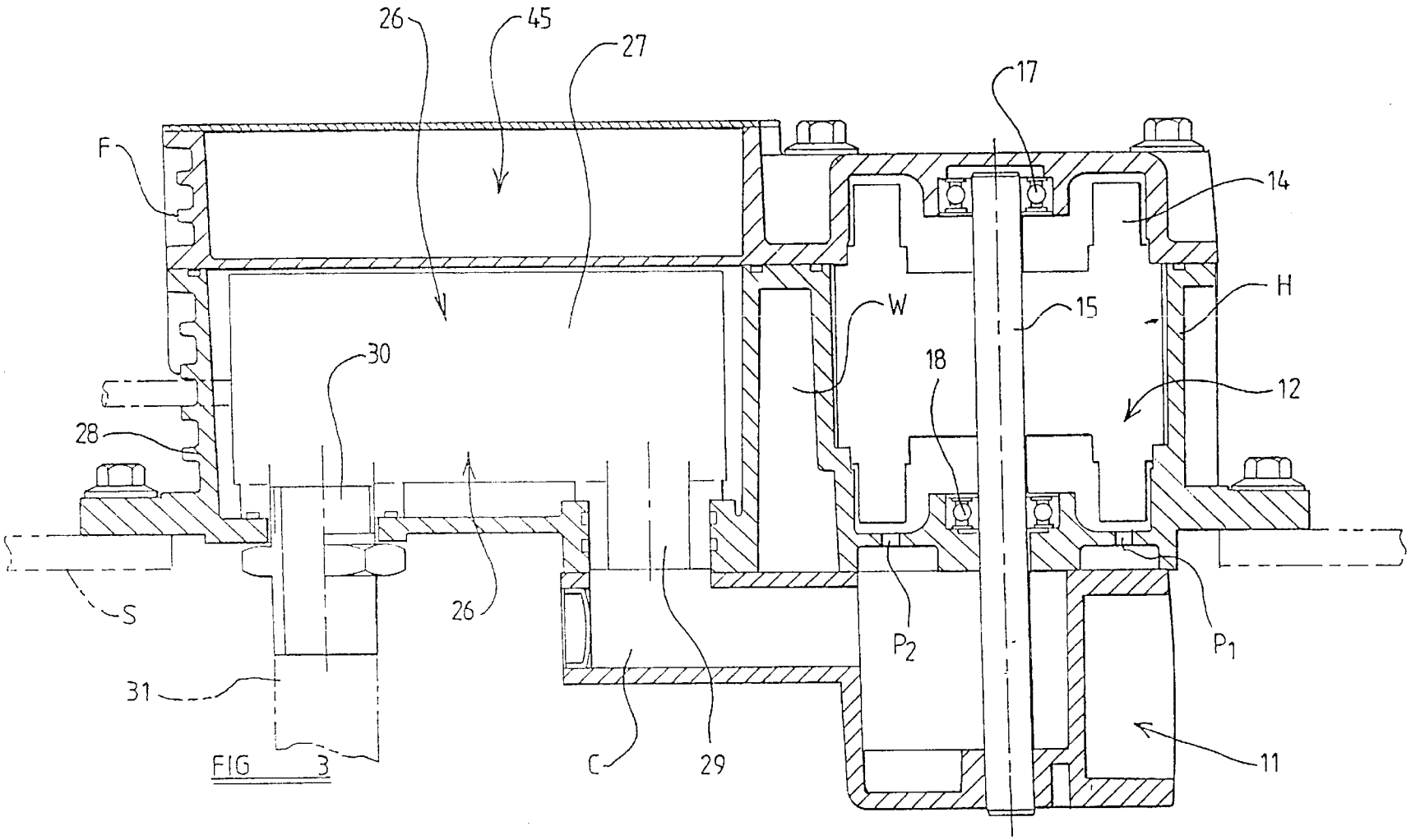
FIG. 3 is a view similar to that of FIG. 1 but of an alternative embodiment of the invention.
Figure 4:
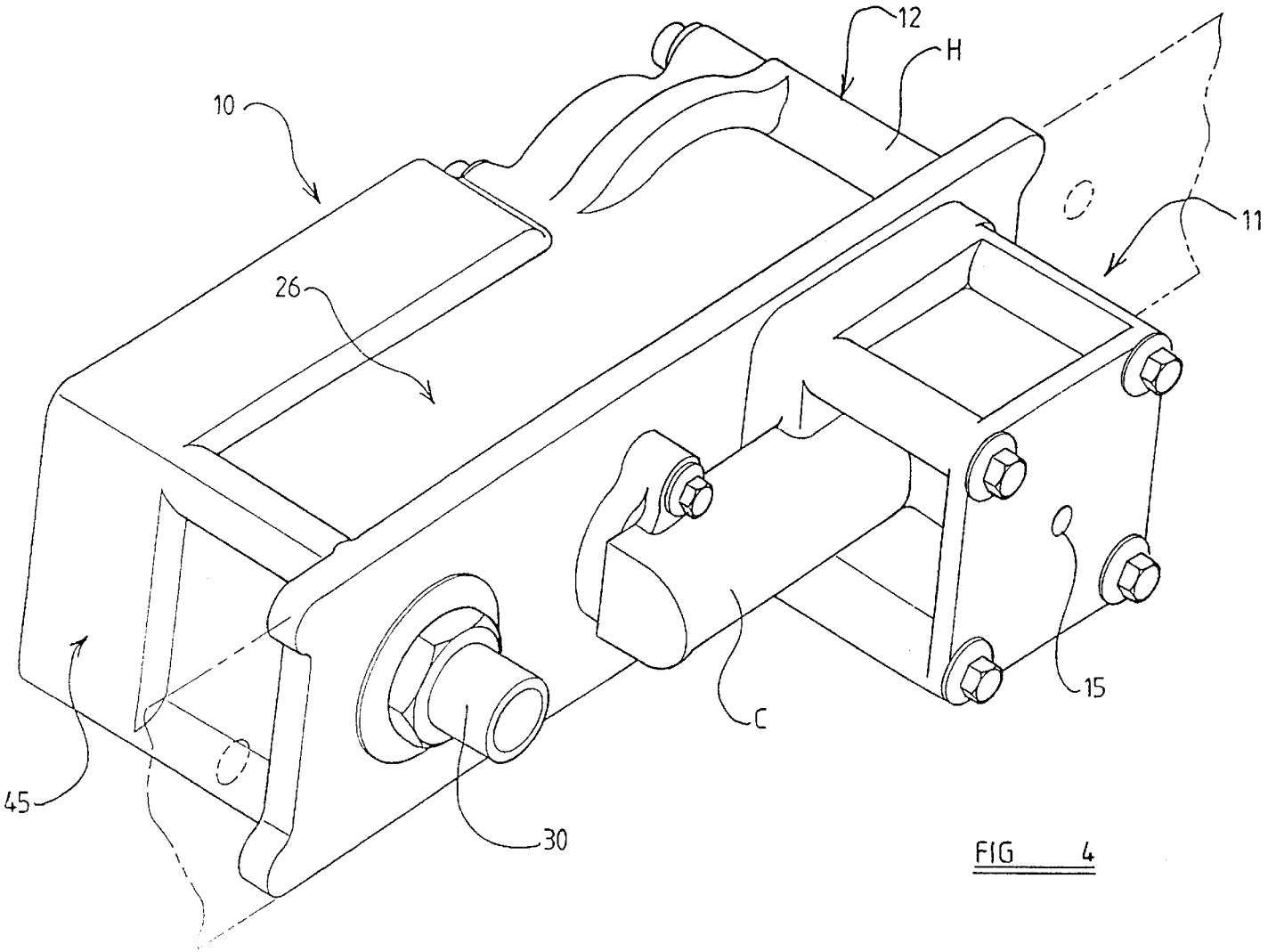
FIG. 4 is a view similar to FIG. 2 but of the second embodiment of an apparatus of the invention shown in FIG. 3, and in an assembled condition.

Referring now to FIGS. 3 and 4, there is shown an alternative pumping apparatus in accordance with the invention. Similar parts are labelled with the same reference numerals.

In this alternative embodiment, there is provided an electric motor 12 to drive a pump 11, a rotor 15 of the motor 12 being connected directly to the pump 11 which pump 11 is axially arranged with respect to the motor 12. However, the motor 12 is located exteriorly of the sump S, and accordingly the motor 12 requires a housing H physically to protect it. The motor housing H is provided integrally with the pump housing 23 in the arrangement shown, but these could be separately provided and connected together as desired.

However, the interior of the motor 12 communicates with the interior of the pump housing 23 and hence receives oil from the sump S, via a pair of passages P1 and P2 for the fluid. Movement of the motive member (rotor) 15 of the motor 12 will cause some exchange of fluid between the pump housing 23 and the interior of the housing H of the motor 12, but if required, there may be proved an impeller means or the like to promote such oil flow through the motor housing H. In each case, the interior of the motor 12 and particularly the rotor 15 thereof will be contacted by the oil and thus the bearings 17, 18 which carry the rotor 15 will be lubricated by the oil. Also the temperature of the stator windings 14 will be stabilised by being in thermal contact with the oil of the sump S.

The oil cooler 26 in this example is not arranged axially with respect to the pump 11 or motor 12 but is arranged to one side of the motor 12, and is sealed from the motor 12 and physically separated therefrom by a wall W. Oil which is pumped by the pump 11 is fed to the oil cooler 26 via a channel C provided from the pump housing 23 to the oil cooler housing 28.

The control means 45 for controlling the speed of the pump 11 is provided in thermal contact with the heat exchanger 27 in a manner such that the temperature of the control means 45 is stabilised by the coolant flowing through the heat exchanger 27 of the oil cooler 26.

In both of the examples described, it will be appreciated that the oil cooler 26 and the control means 45 are located exteriorly of the sump S in the air e.g. in a compartment of an engine housing, and this will enhance oil and control means 45 cooling. In the FIGS. 3 and 4 arrangement, the pump housing 23 and the control means 45 housing are provided with external fins F to promote heat exchange with the air, although these are not shown in the FIG. 4 drawing.

In both of the particular embodiments described, there is provided an oil cooler 26. However such oil cooler may not be essential in every embodiment although the advantage of being able to stabilise the temperate of a control means 45 positioned adjacent the pump 11 may be lost. The advantage of providing the control means 45 so close to the motor 12 is so that leads between the two may be made as short as possible, but in another arrangement where this advantage is not required, the control means 45 may be remotely positioned.

It will be appreciated from the above description and from the drawings that there may be provided a fluid pump, motor, fluid cooler and control means as a modular unit with various housing walls being shared. In another arrangement at least one of the pump, motor, cooler and control means may be provided by a separate unit which is attached to the other unit or units.

If desired, a filter housing 32 may be provided integrally with the pump housing, and/or with the oil cooler housing 28 so that the apparatus 10 provides a self contained lubrication module which may be incorporated into an engine with a wide variety of different positions, without the constraints imposed by an pump mechanically coupled to a driven part of the engine, or the filter position.

If desired the apparatus 10 as seen in and described with reference to the drawings may incorporate a sieve filter to protect the pump 11 particularly, from debris which may be contained within the engine oil, such filter being positioned in an inlet to the pump 11. In the figures, there will of course be an inlet to the pump via a housing of the pump, although this is not visible in all the figures.

Referring now to FIGS. 6 and 7 there is shown a yet another embodiment of the present invention, with similar parts to those described with reference to the previous figures indicated by the same reference numerals.

In this embodiment, a pumping apparatus 10 includes an impeller 16 with is integrally provided with the motor 12.

The motor 12 is a brushless d.c. motor such as a switched reluctance motor and includes stator windings 14 wound on radially inwardly extending formations of an external stator core C, and an internal rotor 15. The internal rotor 15 provides rotor salient poles which, as the stator windings 14 are energised, cause the rotor 15 to rotate in the stator core C. In this arrangement the rotor 15 is restrained axially between two parts H1, H2 of a motor/pump housing 28 into which fluid to be pumped may pass through an axial inlet 29 in one H1 of the housing parts, and be pumped from the housing through an axial outlet 30 of the other of the housing parts H2. Of course if desired, the inlet 29 and/or outlet 30 may be provided other than axially, e.g. at radial positions, although as will be appreciated from what is described below, the fluid is pumped axially of the apparatus 10.

The internal rotor 15 has an internal opening 50 with generally inwardly extending gear teeth like formations, six in this example, indicated at 51. Within the internal opening 50 the impeller 16 is provided, the impeller having generally radially outwardly extending gear-like teeth formations 52, corresponding in number and configuration to the teeth 51 of the rotor 15.

The impeller 16 may be mounted in the rotor 15 or may be free to rotate as indicated in the drawings, but in any event the impeller 16 rotates about an axis which is parallel to but spaced from an axis or rotation of the rotor 15. Thus at any time, only some the teeth 51, 52 are in engagement, and a pumping cavity is provided between the impeller 16 and the internal rotor 15.

However, as the rotor 15 rotates, the impeller 16 will be rotated, albeit in a gerotor fashion within the rotor 15, and as a result, fluid will be pumped with the fluid in contact not only with the impeller 16 but with the rotor 15 (motive member) too.

The apparatus 10 is in use immersed in the lubricant to be pumped, and may be connected with other components of an engine or the like, as with the embodiments previously described and may conveniently be secured to or an integral part of an engine sumps. The apparatus 10 of FIGS. 6 and 7 has advantage in that the overall axial length of the apparatus 10 may be minimised as the impeller 16 is within the rotor 15, thus reducing weight and manufacturing costs too.

In each of the arrangements described above, it will be appreciated that the motor 12 is preferably a brushless motor such an a switched reluctance motor, or a brushless direct current motor.

In each of the examples described, the pumping apparatus 10, or at least the pump 11 thereof is immersed in lubricant in an engine sump(s). In another example, the pump 11 may be immersed in lubricant in a separate lubricant reservoir, but in each case, lubricant from the sump or other reservoir is in contact with the stator 14 and rotor 15 of the motor means 12.

The features disclosed in the foregoing description or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. An apparatus for pumping lubricant in an internal combustion engine, the apparatus including a lubrication pump for pumping the lubricant, an electric motor for driving the pump, the lubricant being pumped from a reservoir in which at least the lubrication pump is immersed, and wherein the motor includes a stator and a rotatable motive member, the stator and rotatable motive member of the motor being in contact with lubricant from the reservoir wherein the pump and the motor are arranged with the pump and the motor immersed in the fluid lubricant in the reservoir, the motor being devoid of a housing or other outer casing.

2. An apparatus according to claim 1 wherein the reservoir for the lubricant is a sump of the engine.

3. An apparatus according to claim 1 wherein the motor is a brushless electric motor, the stator having internal stator windings and an internal rotor, the internal rotor including an axially extending opening with generally radially inwardly formations, and the pump includes an impeller which is received in the axially extending opening, the impeller having generally radially outwardly extending formations which cooperate with the radially inwardly extending formations of the rotor so that the impeller is driven as the rotor rotates, the radially outwardly extending formations of the impeller pumping the lubricant as the impeller is rotated.

4. An apparatus according to claim 3 wherein the impeller rotates in the axially extending opening of the internal rotor about an axis which is parallel to but spaced from an axis about which the internal rotor rotates whereby in use, at any time, only some of the cooperating formations of the internal rotor and the impeller are in cooperation, and a pumping cavity for lubricant to be pumped, is provided between the internal rotor and the impeller.

5. An apparatus for pumping lubricant in an internal combustion engine, the apparatus including a lubrication pump for pumping the lubricant, an electric motor for driving the pump, the lubricant being pumped from a reservoir in which at least the lubrication pump is immersed, and wherein the motor includes a stator and a rotatable motive member, the stator and rotatable motive member of the motor being in contact with lubricant from the reservoir wherein the fluid is pumped by the pump through a heat exchanger where the lubricant is cooled by a coolant in thermal contact therewith, the heat exchanger being located closely adjacent to a housing of the pump, in a position exteriorly of the reservoir.

6. An apparatus according to claim 5 wherein the pump only is immersed in the lubricant in the reservoir, the motor including a motor housing with one or more passages for the lubricant from the pump to the interior of the motor housing.

7. An apparatus according to claim 5 wherein the reservoir for the lubricant is a sump of the engine.

8. An apparatus according to claim 5 wherein the motor is a brushless electric motor, the stator having internal stator windings and an internal rotor, the internal rotor including an axially extending opening with generally radially inwardly formations, and the pump includes an impeller which is received in the axially extending opening, the impeller having generally radially outwardly extending formations which cooperate with the radially inwardly extending formations of the rotor so that the impeller is driven as the rotor rotates, the radially outwardly extending formations of the impeller pumping the lubricant as the impeller is rotated.

9. An apparatus according to claim 8 wherein the impeller rotates in the axially extending opening of the internal rotor about an axis which is parallel to but spaced from an axis about which the internal rotor rotates whereby in use, at any time, only some of the cooperating formations of the internal rotor and the impeller are in cooperation, and a pumping cavity for lubricant to be pumped, is provided between the internal rotor and the impeller.

10. An apparatus for pumping lubricant in an internal combustion engine, the apparatus including a lubrication pump for pumping the lubricant, an electric motor for driving the pump, the lubricant being pumped from a reservoir in which at least the lubrication pump is immersed, and wherein the motor includes a stator and a rotatable motive member, the stator and rotatable motive member of the motor being in contact with lubricant from the reservoir wherein there is provided a control means for the electric motor, the control means being cooled in use by the coolant.

11. An internal combustion engine having a sump for lubricant to be pumped, and an apparatus to pump the lubricant, the pumping apparatus including a lubrication pump for pumping the lubricant and an electric motor for driving the pump, the lubricant being pumped from a reservoir in which at least the lubrication pump is immersed, and wherein the motor includes a stator and a rotatable motive member, the stator and rotatable motive member of the motor being in contact with lubricant from the reservoir and including a management systems which interfaces with a control means of the apparatus which is operative to control motor speed, the management system and control means controlling pump speed according to engine operating conditions.

12. A method of operating an engine according to claim 11 wherein the method includes actuating the pumping apparatus prior to start-up of the engine and/or subsequent to switching off the engine.

13. A method of performing a diagnosis of engine malfunction including providing to an engine management system, an input from a control means of an electric motor of a pumping apparatus, the pumping apparatus including a lubrication pump for pumping the lubricant, and an electric motor for driving the pump, the lubricant being pumped from a reservoir in which at least the lubrication pump is immersed, and wherein the motor includes a stator and a rotatable motive member, the stator and rotatable motive member of the motor being in contact with lubricant from the reservoir.

14. A lubrication module for an internal combustion engine, including a pumping apparatus, the pumping apparatus including a lubrication pump for pumping the lubricant, and an electric motor for driving the pump, the lubricant being pumped from a reservoir in which at least the lubrication pump is immersed, and wherein the motor includes a stator and a rotatable motive member, the stator and rotatable motive member of the motor being in contact with lubricant from the reservoir and the lubrication module further including a lubricant cooler, the pumping apparatus and the lubricant cooler being assembled together.

* * * * *